US005340091A

United States Patent [19]

Hemsath

[11] Patent Number: 5,340,091

[45] Date of Patent: Aug. 23, 1994

[54] BATCH COIL ANNEALING FURNACE

[75] Inventor: Klaus H. Hemsath, Toledo, Ohio

[73] Assignee: Gas Research Institute, Chicago, Ill.

[21] Appl. No.: 49,369

[22] Filed: Apr. 21, 1993

[51] Int. Cl.[5] ..... F27D 17/00

[52] U.S. Cl. ..... 266/256; 266/252; 266/156

[58] Field of Search ..... 266/249, 252, 253, 254, 266/256, 156; 432/77, 182, 179, 178

[56] References Cited

U.S. PATENT DOCUMENTS

| | | | |
|---|---|---|---|
| 1,427,319 | 11/1920 | Peacock | 266/249 |
| 2,050,029 | 8/1934 | Williams | 266/256 |
| 2,146,432 | 7/1937 | Huff | 266/256 |
| 2,201,308 | 8/1938 | Edge | 266/256 |
| 2,254,891 | 7/1940 | DEX | 266/252 |
| 3,112,919 | 10/1960 | Gunow | 266/250 |
| 3,140,743 | 7/1964 | Cone | 266/256 |
| 3,816,901 | 6/1974 | Camacho | 266/256 |
| 3,832,129 | 8/1974 | Derbyshire et al. | 266/256 |
| 3,850,417 | 11/1974 | Elorza | 266/256 |
| 4,275,569 | 6/1981 | Mayers | 62/373 |
| 4,310,302 | 1/1982 | Thekdi | 432/205 |
| 4,502,671 | 3/1985 | Omura | 266/256 |
| 4,846,675 | 7/1989 | Soliman | 266/256 |
| 4,891,008 | 1/1990 | Hemsath | 432/148 |
| 5,018,707 | 5/1991 | Hemsath | 432/148 |

*Primary Examiner*—Scott Kastler
*Attorney, Agent, or Firm*—Frank J. Nawalanic

[57] ABSTRACT

An improved batch coil furnace is disclosed in that the annealing stand or base of the furnace is provided with a source for auxiliary heating or cooling of the work. A cylindrical containment wall is heated by hot burner products of combustion convectively impinging the outside surface of the containment wall. A unique jet tube impingement bundle is positioned within the base to form the recirculating cover atmosphere into jet streams which convectively impinge the inside surface of the containment wall. The furnace atmosphere is thus heated prior to being recirculated into the inner cover with the result that the temperatures of all the coils within the inner cover are more uniform. Provisions are made for cooling the outside surface of the containment wall after the coils have been heated to their transformation temperature. Finally, a baffle is applied to the base portion of the inner cover which, in conjunction with water cooling of the inner cover's annular flange, permits a constant temperature gradient to occur within the inner cover to avoid premature thermal fatigue or shock failure.

26 Claims, 3 Drawing Sheets

Fig. 3
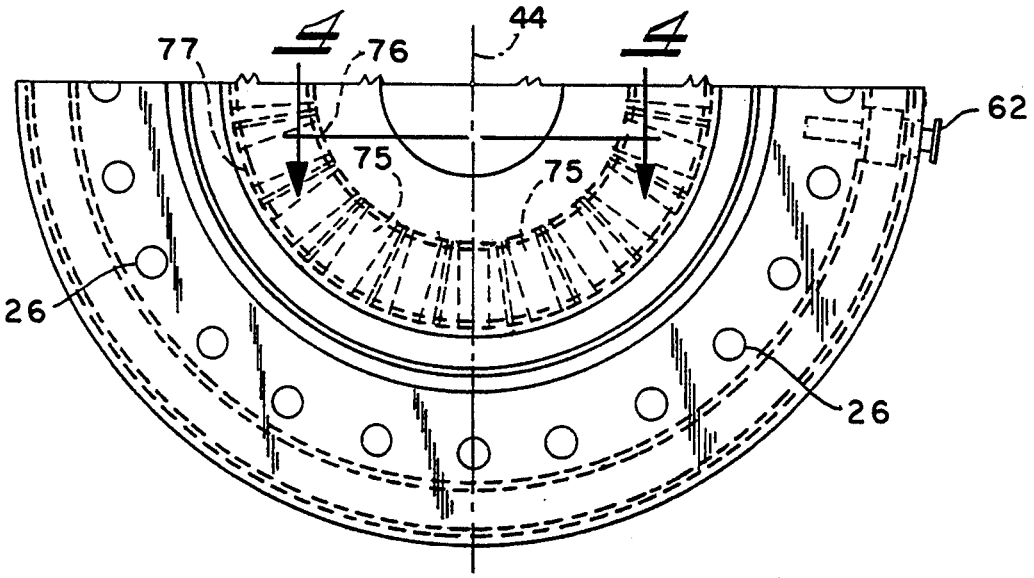
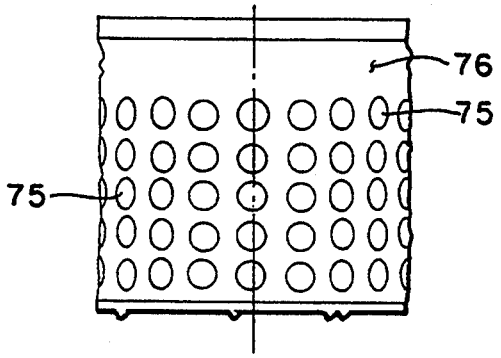
Fig. 4
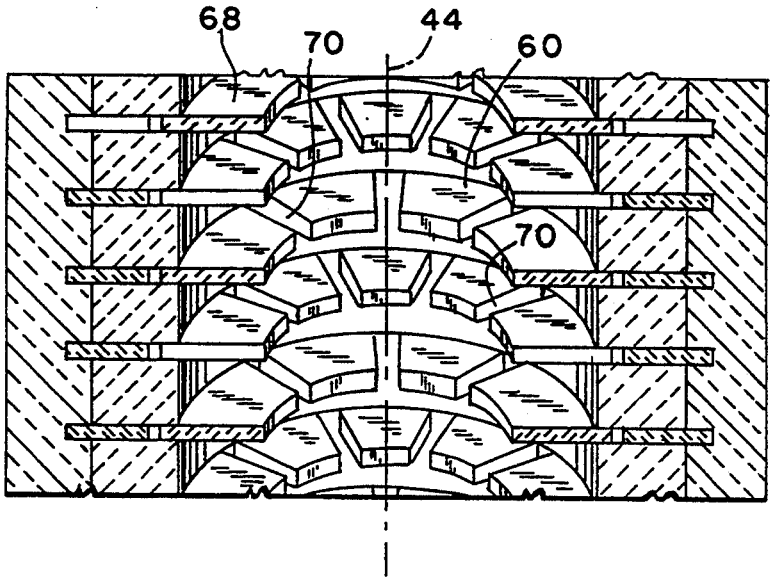
Fig. 5

BATCH COIL ANNEALING FURNACE

This invention relates generally to bell shaped, heat treating furnaces and more particularly to an improved batch coil annealing furnace.

The invention is particularly applicable to and will be described with specific reference to an improved, bell shaped furnace used for annealing coils of strip or sheet steel. However, the invention is not necessarily limited to annealing steel strip, and may have broader application, such as being used for a variety of heat treating processes performed in a batch processing mode.

INCORPORATION BY REFERENCE

The following patents are incorporated herein by reference so that various details and furnace fundamental concepts known in the art need not be shown or described in detail herein:

| Inventor | U.S. Pat. No. |
|---|---|
| Cone | 3,140,743 |
| Mayers | 4,275,569 |
| Thekdi | 4,310,302 |
| Soliman | 4,846,675 |
| Hemsath | 5,018,707 |

Applicants co-pending patent application entitled "METHOD AND APPARATUS FOR BATCH COIL ANNEALING METAL STRIP" assigned to the assignee of the present invention and filed as of the filing date of this application is hereby incorporated by reference and made a part hereof.

BACKGROUND

Metal strip may be heat treated as an endless belt passing horizontally or vertically (looping tower) through a furnace after which the strip is rewound as a coil. Alternatively, the strip may be heat treated in a batch furnace with the strip tightly wound as coils vertically stacked on edge, one on top of the other.

Batch coil annealing furnaces (sometimes called "box annealing furnaces" or "bell shaped furnaces") have been long used and are well known in the industry. Batch coil annealing furnaces include a base or an annealing stand upon which the steel coils are stacked vertically, edge upon edge, and over which a removable inner cover is placed. It is to be appreciated that the metal strip or coil is formed by winding the strips or sheets into coils having an axial passage bounded by the inner diameter of the winding. Several of the coils are stacked edge to edge and separated axially by a diffuser plate positioned in between adjacent coils. An outer cover, in turn, is placed over the inner cover. The outer cover along with the inner cover and the base comprise the three major components of the furnace. Both covers are removably sealed to the base and the outer cover typically contains gas fired burners for heating the inner cover. The inner cover, in turn, transfers heat to the coils. The primary mode of heat transfer from the cover to the coils is by radiation. Additionally, a defined furnace atmosphere is circulated within the inner cover to achieve more rapid and uniform heat transfer by convection while maintaining a desired gas composition for metallurgical process purposes. Batch coil annealing processes in the steel mill industry typically take anywhere from about twenty hours to as long as several (3) days to complete.

More specifically, coils are stacked coaxially upon one another within the inner cover with the axial passage of each coil aligned to form central, axial path. A radial fan in the base of the annealing furnace in alignment with the axial path draws furnace atmosphere within the inner cover down through the axial path into the annealing stand or base. A diffuser plate within the base then directs or causes the inner cover atmosphere to travel through the base and vertically upward back into the inner cover at a position within the annular space between the inner cover and the outside diameter of the coiled strip. The atmosphere then travels up through a top space between the top of the coils and the top of the inner cover and back down to the fan through the axial path in the center of the stack of coils.

Even with the use of a recirculating fan, there is nonuniform heat transfer to the work and the rate of heating to achieve annealing is limited. The atmosphere heats (from the hot wall of the inner cover) as it rises in the annular space between the coils and inner cover and is hottest when it reaches the top of the coils. The top outside corner of the top coil is exposed to the radiant energy from the side and the top of the inner cover and is the hottest spot in the stack of coils. On the other hand, the lower most corner of the lowest coil is, in contrast, the coldest spot during heating of the work. This results in a temperature differential which in turn limits the rate at which the work is heated and the rate at which uniformity of the temperature within the coils can be achieved. The problem is further compounded by the fact that the upper coils in the stack are usually the smaller and lightest coils.

Turning next to the cooling part of the process, it has been known in the past to provide base cooling. Base cooling has been achieved using either internal heat exchangers or external heat exchangers. The internal heat exchangers are conventionally supplied under the brand named INTPAK00L TM and basically comprise bare or ribbed tubes which are installed as round coil in the base. The tubing is prone to fail because it is suddenly subjected to cold water which leads to localized boiling. Subjecting the internal coils to numerous heating-cooling cycles causes thermal fatigue as well as thermal shock. The end result is a break of the heat exchanging tubing after being exposed to a finite number of thermal stress cycles with the result that there will then be a lost load of steel as a result of the water normally intended to be circulated within the coils, being converted to steam and oxidizing the work. One of the patents incorporated by reference herein, Mayers U.S. Pat. No. 4,275,569, is directed to the concept of extending the life of the internal heat exchangers. External heat exchangers suffer from another problem. They require considerable space which is usually at a premium in the basement of a typical annealing facility. Also external heat exchangers normally fail at the connections between heat exchanger and base. Again, thermal fatigue is the cause of the failure. Cracks normally lead to loss of atmosphere and leaking oxygen with the result that when the failure occurs, oxidation and a lost work load will also result.

Apart from the heat distribution aspects of the invention, inner covers for batch coil annealing furnaces are made from heat resistant alloy such as 309 stainless to withstand relatively high temperatures (although not "high" in the furnace sense) and repeated heating and cooling under production conditions. However, inner covers tend to fail on a regular basis. Failure occurs in one of two general locations. Failures occur in the proximity of the burners where flame gases directly impinge on the outer surface of the inner cover. The other major failure location is in the frustoconical section between the vertical cylinder section and horizontal bottom flange of the inner cover. Failures in both cases occur because of crack formation i.e., fatigue cracks. When failure occurs, there is increased leakage of the protective atmosphere gas from the inner cover. In the case of HNX gas such leakage is tolerable as long as the crack is small. However, in case of high hydrogen content atmospheres, the cracks result in a larger loss of atmosphere due to the lower density of atmosphere gas and will eventually create an unsafe condition when pure hydrogen escapes through a large crack and mixes with air. Numerous efforts have been made to eliminate or reduce the frequency of the failures. More expensive alloys have been used. Radiation shields have been added to the inner cover in the vicinity of the burners. Corrugated inner covers have been tried. Other attempts to address this problem have included different welding techniques as well as modified flange cooling or heating approaches. Despite these efforts, inner covers continue to fail on a regular basis.

SUMMARY OF THE INVENTION

Accordingly, it is a principal object of the present invention to provide a batch coil annealing furnace which achieves improved heat transfer with the work.

This object along with other features of the present invention is achieved in a bell shaped, batch furnace for annealing a plurality of coils of wound metal strip. The coils are vertically stacked on a base and covered by a removable inner cover sealed to the base with the inner cover in turn being covered by a removable outer cover likewise sealingly secured to the base. The base includes a support mechanism for supporting the coils at a fixed elevation within the inner cover and a recirculating fan for drawing furnace atmosphere from the inner cover to the base and back to the inner cover. A generally cylindrical containment wall spaced radially outwardly from the recirculating fan prevents escape of the furnace atmosphere from the base and a diffuser mechanism is employed within the base to direct the furnace atmosphere from the inner cover to the containment wall prior to the furnace atmosphere reentering the inner cover. A heating arrangement is provided for heating the containment wall within the base whereby the furnace atmosphere is heated prior to being recirculated back to the inner cover to provide a more uniform heat distribution between the top most edge portion of the top coil and the bottom most edge portion of the bottom coil. The invention further includes providing for a cooling mechanism to cool the containment wall and a control mechanism is then used for sequencing the heating and cooling mechanisms so that the cooling mechanism is activated after the heating mechanism has been deactivated.

In accordance with another important feature of the invention, the diffuser arrangement includes a plurality of radially extending, jet impingement tubes. The fan has an impeller centrally disposed within a fan bung and the fan bung occupies a central, circular area of the base. Each jet impingement tube extends from a position spaced relatively closely to the fan bung to a position spaced relatively closely to the containment wall whereby furnace atmosphere is drawn by the furnace fan into the base and caused to change direction and flow radially outwardly through the jet impingement tubes and into jet impingement contact with the containment wall whereby high heat transfer coefficients with the containment wall are obtained.

In accordance with yet another aspect of the invention the base includes a second cylindrical burner wall spaced radially outwardly from the containment wall and vertically extending the length of the containment wall so that the containment wall and the burner wall define an annular vertically extending heat transfer space. Positioned within the annular heat transfer space is a plurality of vertically spaced baffles each of which extends radially outwardly from the containment wall to the burner wall with each baffle having at least one slitted opening. The slitted openings in adjacent baffles are circumferentially offset with respect to one another whereby the containment wall becomes convectively heated by jet impingement turbulence created between vertically adjacent baffles as the hot burner products of combustion fired into the annular heat transfer space at one axial end turbulently travel through the heat transfer space to the opposite axial end.

In accordance with still another aspect of the invention a water jacket is in heat transfer contact with the burner wall and the control mechanism is effective to furnish a coolant to the water jacket when the burners are not activated. When ambient air is "fired" into the annular heat transfer space cooling from the water jacket to the ambient air to the containment wall access but in a manner which is not prone to induce thermal fatigue failures.

In accordance with yet another aspect of the invention the inner cover has a vertically extending cylindrical section, a closed end section at one axial end of the cylindrical section and an open end at the opposite axial end of the cylindrical section. The open end includes an annular flange end and a frusto-conical section extending between the annular flange and the cylindrical section. A cylindrical baffle of the same diameter as the cylindrical section extends from the juncture of the frusto-conical section with the cylindrical section of the inner cover vertically downwardly to a vertical position generally adjacent the annular flange. The containment wall is about the same diameter as the cylindrical baffle whereby the furnace or inner cover atmosphere is recirculated by the recirculating fan into the inner cover without impinging the annular flange thus avoiding thermal fatigue or thermal shock failure of the flange. Still further the flange is water cooled and the cylindrical baffle prevents furnace atmosphere from contacting the frusto-conical section thus permitting the frusto-conical section to assume a constant temperature gradient obviating thermal fatigue otherwise resulting from temperature variations.

It is an object of the present invention to provide an improved inner cover for use in bell shaped annealing furnaces.

It is yet another object of the present invention to provide a thermal fatigue resistant inner cover for use in batch coil annealing furnaces.

It is another object of the invention to provide an improved annealing stand or base for use in batch coil annealing furnaces.

Yet another object of the invention is to provide an improved base which is effective to both heat and cool the inner cover atmosphere.

Still yet another object of the invention is to provide auxiliary base heating in a batch coil annealing furnace.

Still yet another object of the invention is to provide an improved, diffuser mechanism for controlling the flow of inner cover atmosphere within the annealing stand or annealing base.

Still another object of the invention is to provide an improved arrangement for efficiently transferring heat from gas fired burners mounted in the base of the annealing stand of a batch coil annealing furnace.

Still yet another object of the invention is to provide improvements in batch coil annealing furnaces which allow a more uniform temperature distribution within stacked coils of a batch coil annealing furnace.

Still yet another object of the invention is to provide improvements in a batch coil annealing furnace which reduces the overall heat treat process time.

Another object of the invention is to provide a heating/cooling arrangement within the base of a bell shaped furnace which is not suspect of thermal fatigue failures resulting in short life of the cooling mechanism.

Yet still another object of the invention is to provide improvements in a batch coil annealing furnace which improve product quality of the coiled strip of a batch coil annealing furnace.

Still another object of the invention is to provide an improved, batch coil annealing furnace which takes up a minimal amount of floor space in the plant.

A still further object of the invention is to provide a coil annealing base which has provisions for heating and/or cooling the furnace atmosphere within a compact configuration occupying about the same floor space as conventional bases.

Yet another object of the invention is to provide a long lasting inner cover for a batch coil furnace.

Yet still another object of the invention is to provide an economical, cost efficient, simple batch coil annealing furnace.

These and other objects of the present invention will become apparent to those skilled in the art upon reading and understanding the detailed description of the invention set forth below.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof and wherein:

FIG. 3 is a schematic, partial top view of a portion of the annealing base shown in FIG. 2;

FIG. 4 is a partial section view of a portion of the annealing furnace base taken along the lines 4—4 of FIG. 3;

FIG. 5 is a schematic perspective view of a portion of the furnaces base showing details relating to the heating wall.

DETAILED DESCRIPTION OF THE INVENTION

Figure 1:
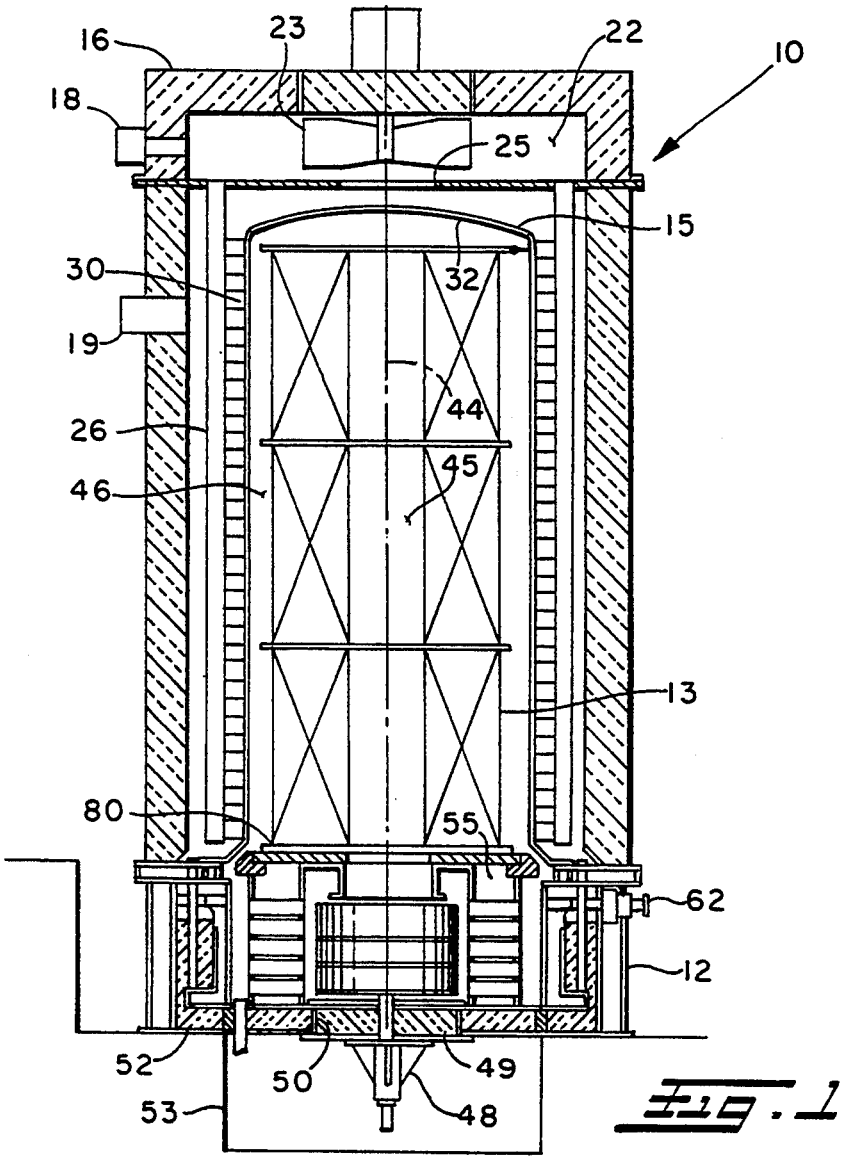
FIG. 1 is a schematic, plan, section view of the batch coil annealing furnace of the present invention.

Referring now to the drawings wherein the showings are for the purpose of illustrating preferred embodiment of the invention only and not for the purpose of limiting the same, there is shown in FIG. 1 in schematic form a bell shaped annealing furnace 10. Annealing furnace 10 includes three (3) fundamental components. First, there is an annealing stand or base 12 which is fixed or stationary i.e., secured to ground and upon which a plurality of coils 13 of metal strip are stacked on edge vertically as shown in FIG. 1. If the coils are of course separated vertically by conventional diffuser plates (not shown in any detail in the drawings) but which permit cover atmosphere to flow radially between the exposed edges of adjacent coils. Enclosing a covering to coils 13 is a sealable, removable inner cover 15. Covering or enclosing inner cover 15 is a sealable, removable outer cover 16.

Outer cover 16 carries a heating mechanism, typically a gas fired burner 17 which is used to heat the outside surface of inner cover 15 which in turn radiates heat to coil strips 13 in a manner to be described hereafter. Conceptually, a burner 17 is simply mounted into the wall of outer cover 16 and directly impinges inner cover 15 with the hot products of combustion which in turn are then exhausted to an after burner (not shown) or stacked (not shown) through a flue 19. Outer cover 16 illustrated in FIG. 1 employs additional burner structure to provide improved heating of inner cover 15. This structure includes formation of a plenum chamber 22 at the closed axial end of outer cover 16 which houses an outer cover fan 23. Outer cover fan 23 pulls furnace atmosphere within outer cover 16 through a central opening 25 in plenum chamber 22 which is heated by burner 17. Fan 23 then forces the heated furnace atmosphere into axial ends of a plurality of longitudinally extending distribution pipes 26 which are circumferentially spaced about plenum chamber 22. The furnace atmosphere exits distribution pipes 26 through small orifice jets that impinge against inner cover 15. After impinging inner cover 15 the "spent" gas jets are drawn by fan 23 through the underpressure zone 25 back into plenum chamber 22. A baffle (not shown) in flue 19 controls the pressure of the furnace atmosphere within outer cover 16. Again, the plenum chamber 22 and distribution pipe 26 can be replaced by conventional burners simply firing their product of combustion against inner cover 15. The heating arrangement disclosed is preferred because it uniformly heats inner cover 15 along its length and in conjunction with the base heating of the invention assures uniform temperature distribution of coils 13.

Figure 6:
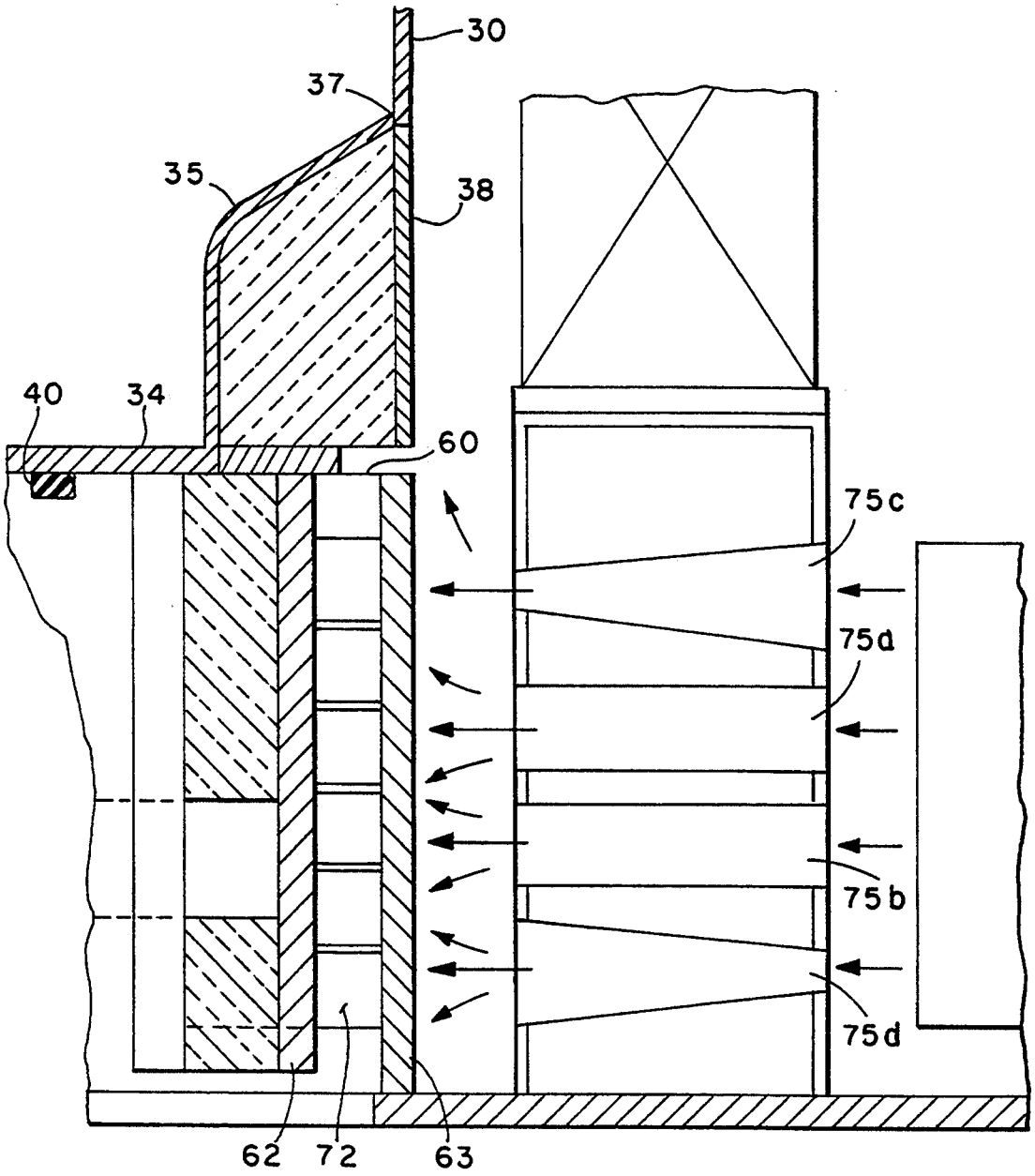
FIG. 6 is an enlarged schematic section and view of a portion of the furnaces base showing heat transfer with the containment wall of the base.

Inner cover 15 has a vertical or longitudinally extending cylindrical section 30. One end of cylindrical section 30 is closed as at 32 in the shape of a sphere. The opposite axial end of longitudinally extending cylindrical section 30, is open and as best shown in FIG. 6, includes an annular sealing flange 34 which terminates in a frusto-conical section 35 which in turn terminates at cylindrical section 30. At the juncture 37 or intersection between frusto-conical section 35 and cylindrical section 30 is a cylindrical, baffle shielding baffle 38 which extends longitudinally or vertically downward to a position closely adjacent to that of annular sealing flange 34. In the preferred embodiment, shielding baffle 38 has the same inside diameter as does the inside diameter of cylindrical section 30. Annular sealing flange 34 is removably sealed to base 12 by an elastomer seal 40 which is maintained at a sufficiently cool temperature by means of a water jacket 42. The details of the elastomer sealing arrangement are disclosed in my co-pending application incorporated by reference herein and identified above. Reference can be had to that application for a more detailed explanation of the sealing and insulation employed with respect to inner cover 15 than that which will be discussed or described in detail herein. Suffice it to simply note that two radially spaced seals are employed and that the annular space between the two circular, concentric elastomer seals 40 is subject to a vacuum which vacuum provides a positive seal. Insofar as the invention disclosed herein is concerned, it is sufficient to simply note that a cooling medium flows in water jacket 42 which cooling medium maintains the temperature of elastomer seals 40 within the temperature limits of the elastomer material employed in the seals. The cooling medium is appropriately valved in water jacket 42 in a manner which will be described hereafter through the annealing base for purposes of cooling the coils 13 after coils 13 have been heated to their transformation temperature in the annealing process.

Referring still to FIG. 1 coils 13 are stacked so that their inside diameters are centered relative longitudinal center line 44 (which is also the center line of base 12 of inner cover 15). Thus coils 13 are concentrically stacked to define a cylindrical central passageway 45. Also, between the outside of coils 13 (i.e., outside diameter) and the inside of inner cover 15 (i.e., inside diameter) is an annular space 46. A base fan 48 in base 12 acts to pull the inner cover 15 atmosphere down through cylindrical central passageway 45 and push the atmosphere back into inner cover 15 through annular space 46 in a manner which will be discussed in further detail below.

Figure 2:
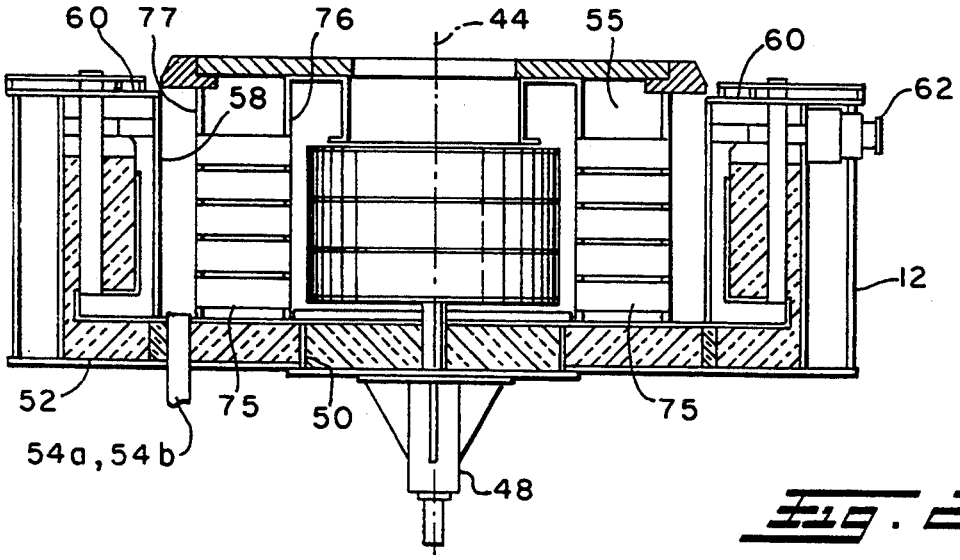
FIG. 2 is an enlarged schematic, sectioned view of the annealing base or stand used in the batch coil annealing furnace of FIG. 1.

Referring now to FIGS. 1, 2 and 3, base fan 48 is of course centered relative to cover center line 44. Base fan 48 with its impeller 49 is housed, as is conventional, within a fan bung 50 which in turn is secured to the insulated bottom framework 52 of base 12. As shown in FIG. 1, framework 52 in turn is secured to a pit foundation 53 or the like. Extending from the bottom framework 52 vertically upwards for a fixed distance is a plurality of radially extending spacers 55. The spacers are circumferentially spaced and collectively form an annulus extending from the I.D. (inside diameter) to the O.D. (outside diameter) of coils 13. Placed on top of spacers 55 is diffuser plate 14. On diffuser plate 14 sits the lowest most coil 13. Also extending through bottom framework 53 is a gas inlet **54*a* and a gas outlet 54*b* for supply furnace atmosphere of a given composition to inner cover 15. This atmosphere could be inert, HNX or $H_2$. Also, gas inlet 54*a* and gas outlet 54*b* could act to draw a vacuum in inner cover 15**.

Spaced radially outwardly from spacers 55 and vertically upwardly from bottom framework 52 to a position vertically or longitudinally equal to the top of spacers 55 is a cylindrical containment wall 58 having a diameter about equal to that of cylindrical section 30 of inner cover 15. As noted, containment wall 58 extends vertically from bottom framework 52 upward to annular flange mounting surface 60. As indicated above, annular sealing flange 34 of inner cover 15 rests or seats on flange mounting surface 60 of base 12.

In accordance with one unique aspect of the invention, a mechanism is provided for heating containment wall 58 and/or cooling containment wall 60 during a heat treat cycle performed by furnace 10. In the preferred embodiment this is accomplished by means of a pair of gas fired burners 62 mounted in base 12. The burner arrangement includes a burner wall 63 spaced radially outwardly from containment wall 58 and concentric therewith to define an annular heat transfer space 65 therebetween. At the bottom of heat transfer space 65 and adjacent bottom framework 52, an outlet is in fluid communication with a flue 67 so that flue 67 causes the hot products of combustion emanating from burners 62 to travel from burners 62, down through heat transfer space 65 and out through flue 67. It is known that heat transfer in heat transfer space 65 which is relatively long and narrow will be only nominal or moderate in effect. To increase heat transfer from burners 62 to containment wall 58 the concept of slot jet impingement heating, set forth in my U.S. Pat. No. 5,018,707 is employed. More particularly, a plurality of vertically spaced baffles extending radially from burner wall 63 to containment wall 58 and placed at equal longitudinal increments along the vertical distance thereof is provided. Formed in each baffle 68 is a plurality of circumferentially spaced slots 70 and slots 70 are aligned so that slots 70 of adjacent baffles 68 are never in alignment with one another. Slots 70 act as orifices which force the burner products of combustion as they travel through heat transfer space 65 to pass through a torturous path in which each baffle 68 is heated by jet impingement from an overlying slot 70 of an upward overlying baffle 68. The jet impingement thus heats each baffle by convection to a high temperature and that temperature from each baffle 68 is transmitted by conduction to containment wall 58. To clarify, the space between adjacent baffles 68 will be filled with products of combustion which (because of slots 70) are turbulent. The hot turbulent products of combustion, will impinge the outermost surface of containment wall 58 and this in and of itself will provide heat transfer to containment wall 58. In addition, however, heat transfer is also occurring by conduction vis-a-vis baffles 68 as described above. This significantly increases the heat transfer from the burner products of combustion to containment wall 58.

For cooling, water is used to reduce the available temperature differential towards the end of the cooling cycle. This water is introduced into the space 72 that is occupied by hot combustion products during the heating cycle. Water fills the void 72 between containment wall 63 and backwall 62 resulting in the cooling of containment wall 63. When heating of coils 13 is completed, burners 62 are shut off and the valve can be opened to admit water to space 72. Simultaneously, the air and gas supply lines to the burner 62 are closed so that water is prevented from entering the combustion gas supply system. The cold surface of containment wall 63 will be contacted by large jets emanating from tubes 75. These large jets will produce very large heat transfer coefficients on the internal atmosphere side of containment wall 63. These coefficients will approach in magnitude the coefficients on the water wetted side that are still higher even when the water is flowing at rather low velocities. However, to prevent sudden steam formation on the water side water motion must be maintained at all times.

The prior art annealing stands and/or bases had various types of diffuses for directing the flow of the inner cover 15 furnace atmosphere through the base and back to the inner cover 15. A prior art diffuser is illustrated in Thekdi U.S. Pat. No. 4,310,302 and in Soliman U.S. Pat. No. 4,846,675. These diffusers simply directed the flow of the furnace atmosphere from the inner cover 15 through the base and back to the inner cover 15.

In accordance with the invention the atmosphere drawn by base fan 48 into base 12 is passed through a plurality of jet impingement tubes 75 where the furnace atmosphere is formed into free standing jets which impinge at high velocities (in excess of 10,000 ft/min) containment wall 58. As best shown in FIGS. 2, 3, 4 and 6, jet impingement tubes 75 are stacked one on top of the other in rows equal to the height of fan impeller 49 (there being 5 such impingement tubes per row illustrated in the preferred embodiment) which in turn are mounted within radially inwardly and radially outwardly cylindrical mounting walls 76, 77. The diameter of cylindrical inward mounting wall 76 is slightly larger than the diameter of fan bung 50 to assure that the atmosphere drawn by fan 48 is in fact pumped through jet impingement tubes 75. The diameter of cylindrical outward mounting wall 77 on the other hand, is spaced a predetermined distance from the diameter of containment wall 58 to allow the free standing jet streams exiting jet impingement tubes 75 to expand radially and thus impinge the entire surface area of containment wall 58.

As best illustrated in FIG. 3, each impingement tube 75 is orientated or centered along a radial line which would intersect center line 44 of fan 48. Also, as illustrated in FIG. 6, for the preferred embodiment, jet impingement tubes designated as 75*a*, 75*b* are all of the same size and uniform dimension throughout. Directing furnace atmosphere through round tubes of constant diameter will generate jet streams at the desired velocities. However, it is possible to vary the shape of the impingement tubes and two such variations are shown in FIG. 6. In one variation, designated as 75*c*, the tube narrows from its entrance to its exit end. This will result in a significant increase in jet speed whereas in the other alternative embodiment designated as 75*d* the jet impingement tube increases in diameter from its entrance to its exit end. Importantly, no matter which tube design is used, the high jet impingement against containment wall 58 produces a uniform temperature imparted to the furnace atmosphere gases as they are pumped or pushed into or within inner cover 15. Heat transfer co-efficient in the range of 25 to 40 BTU/° F-HR-FT$^2$ can be expected. Importantly, the temperature of the gases at the lowest most portion of the coils as indicated by reference numeral 80 in FIG. 1 is approximately equal or more closely equated to the temperature of the atmosphere of the uppermost coil corner as indicated by reference numeral 81. That is, as discussed above, the temperature at coil corner 81 is the hottest because of radiation from 2 surfaces. By pumping heated furnace atmosphere from base 12, the hottest point of the atmosphere contact is lowermost coil contact 80. Thus there is a better balance obtained. Accordingly, a better control of the transformation temperature can be obtained resulting in an improved process both from a product quality and from a faster through-put time consideration.

A more subtle consideration is the fact that since the temperature of the furnace gases is being maintained uniformly, vertical or longitudinally extending section 30 of inner cover 15 is being maintained at a more uniform temperature level than that of the prior art covers. Thus, thermal fatigue resulting from temperature variation of vertical section 30 is reduced but also, because the juncture 37 is maintained at a uniform temperature, this allows dissipation or more uniform dissipation of the temperature gradient between annular flange 34 and vertical section 30 of inner cover 15. Finally, the presence of cylindrical baffle 38 prevents the hot gases from impinging against frusto-conical section 35. This is best shown in FIG. 6. Thus, control for a gradual change in temperature can be effected from the water cooled flange section 34 to vertical section 30 vis-a-vis a gradual temperature gradient in frusto-conical section 35. This gradient can not be achieved if the hot inner cover furnace atmosphere could impinge against frusto-conical section 35.

In general summary, an improved base or annealing stand 12 has been disclosed. The annealing stand provides a source of auxiliary heat which allows better control of the heat distribution within the metal coils 13. This is achieved by jet impingement both by the jet impingement tube 75 and by the use of slot jet heating by gas fired burners 62. Further, the arrangement permits cooling of the atmosphere within the base to also occur without the problems afflicting cooling arrangements used in conventional prior art devices. Finally, the base design disclosed permits an easy fabrication so that a vacuum can be drawn within inner cover 15 if it is desired to draw a vacuum.

The base in a conventional batch coil annealing stack serves several purposes. It must support the weight of the stack of coils which can exceed 100 tons. During heating hot gases are drawn into the base by the recirculation fan and are pressurized in order to pass between inner cover and coil. In this pass the gases receive heat from both the inner cover and from the coil. The gases give off this heat after they enter the convector plates and when returning through the center opening of the coil to enter the fan.

An analysis of opportunities for heating the coil at a faster rate reveals the strong influence of recirculation temperature on the rate of heating. By heating the recirculating gases inside the base the gases will enter the annulus between inner cover and coils at a higher temperature. The lowermost corner of the lowest coil suddenly is heated much faster. This faster heating rate not only leads to faster heating rates for the entire stack of coils but also reduces temperature differences between top corner of the top coil and lower corner of the lowest coil. The end result is improved productivity and improved temperature uniformity leading to improved product quality.

During the cooling process only cooling rates are of importance. Provision of cooling surfaces inside the base increases cooling rates significantly. By using cooling water with a very low temperature a major reduction in cooling rates can be achieved.

Several approaches have been used in the past to provide base cooling. None of the proposed approaches has found widespread acceptance. Both internal heat exchangers and external heat exchangers have been used. The internal heat exchangers consist of bare or ribbed tubes that are installed as a round coil in the base. The tube material tends to fail because it is suddenly subjected to cold water which leads to local boiling and repeated changes between several modes of heat transfer. The end result is a break of the heat exchanger tubing after many such exposures and a lost load of steel which has been oxidized by steam.

External heat exchangers suffer from another failure. They require considerable space which is usually at a premium in the basement of a typical annealing facility. These external exchangers normally fail at the connections between heat exchanger and base. Again thermal fatigue is the failure mode. Cracks normally lead to loss of atmosphere and inleaking oxygen with resulting oxidation and loss of load.

While both types of heat exchangers result in considerable productivity improvements they are consistently employed in only a small percentage of installations. With frequent and regular maintenance these exchangers can be kept working and can increase production significantly. None of the U.S. installation are known to have ever had auxiliary heating in the base.

A conventional base has three major parts; an outer containment vessel to contain the recirculating atmosphere, a support for the stack of coils, and a recirculation fan with diffuser. The diffuser not only needs to convert dynamic pressure into static pressure but also must turn the flow from the horizontal to the vertical.

In the late sixties and early seventies another element was added, the internal cooling coil or Intrakool. Life expectancy of these coils was short and they consumed a major amount of horsepower. Only a few users have continued to use these cooling coils despite their effectiveness in reducing cooling times.

The base design of the invention contains the three major elements of a conventional batch coil annealing system; containment vessel, support structure, and recirculation fan and adds four other features. These four additional features are; a diffuser that splits the recirculating gases into a multitude of jets, a cylindrical heat exchanger surface doing double duty as part of the containment vessel, a water cooled flange against which both inner cover and heating cover are sealed, a bottom section that has sealed insulation preventing oil condensation, and a vacuum connection that can evacuate inner cover and base in a very short time.

In order to accelerate heating and cooling several other features have been added to the outside of the base. The cylindrical heat exchanger surface just mentioned is heated from the outside by a set of gas fired burners and the gases are directed downwards through an annulus formed by the cylindrical heat exchanger surface and a concentric downwards extending wall. Because convective heat transfer in an annulus is comparatively low a previous invention known as the slot jet enhanced heat transfer method, can be applied. The same cylindrical heat exchanger surface can also be used to assist in cooling to very low temperatures. To this end the entire annulus and the down coming section are fabricated as a continuous vessel that can contain a cooled liquid such as water, glycol or brine. The water cooled top flange has several functions. It serves as one side of the pair of vacuum flanges and simultaneously serves as one side of the pair of flue gas flanges.

The effects of the redesign of the base are many and major. By being able to apply a vacuum to base and inner cover several benefits arise. When a base is charged with a new coil the spaces between the wraps are filled with air and the surfaces are covered with a thin film of oil. After the inner cover has been set sealingly onto the base the air must be removed before heating can begin. The air is purged out of the system requiring many volume change of atmosphere when HNX is used. In the case of hydrogen systems purging takes even longer and is much more expensive. With hydrogen the base must first be purged with nitrogen before the switch to hydrogen is made which requires additional purging and additional waste of clean gases. All these several purging operations can be replaced by a one time evacuation requiring much shorter time and a one time refill with the final process atmosphere. Costs for process gases are reduced, productivity is increased, and residual air is removed from the inner wraps.

The novel diffuser converts unavoidable dynamic pressure loss into greatly enhanced heat transfer and makes the limited heat exchange surface of the base highly productive. This high heat transfer on the inside surface of the cylindrical heat exchanger combined with the high heat transfer on the outside of the cylindrical heat exchanger combine for a high overall heat transfer coefficient and contribute in a major way to reductions in heating and cooling times. This added exchanger also has implications on product quality. Adding heat below the lower corner of the lowest coil increases temperature uniformity along the stack height and the normally observed differentials from top to bottom are significantly reduced making achievement of superior metallurgical properties easier to accomplish.

The same heat transfer area plays an even greater role during the cooling cycle. In the final stages of the cooling cycle a substantial amount of viscous energy dissipation occurs and acts as a source of heat for the gas passing through the fan. The proximity of the water cooled heat exchanger negates this heating effect and also permits to cool the steel to very low temperatures (125° F. to 175° F.) and can eliminate the present practice of open cooling on the floor before temper rolling altogether. Such cooling to lower temperature has quality and inventory reduction implications but must be possible within acceptable cooling cycle times.

The overriding benefit of the base modifications may, however, be the ability to draw a vacuum at any time. The boiling temperature of any substance is dependent on the absolute pressure. Any decrease in pressure is accompanied by an attendant decrease in the boiling temperature. Boiling results in enhanced mass transfer and removal of oils is greatly accelerated. More importantly, complete removal of oil vapors can be achieved not only faster but also at lower temperatures. Polymerization, pyrolysis, and soot formation all occur at certain absolute temperature ranges. By removing all oils before any of these reaction temperatures are reached or exceeded it becomes possible to avoid soot formation and fouling of steel surfaces.

At a previously determined time into the cycle heating of the stack of coils is interrupted and base and inner cover are evacuated. While temperatures continue to equalize within the coil the residual oil is vaporized and is pumped out of the system. The oil vapors are condensed in a special condenser or cold trap and can be recovered. The system is then swept clean of all traces of oil vapors and the heating cycle can be resumed. This cleaning shelf cycle does consume some time. Any increase in productivity in other parts of the cycle is, therefore, highly welcome to prevent loss of productivity. In fact, the proposed system will not only compensate for losses in the shelf cycle but will further increase productivity by a large margin.

Overall, the effects of the modifications to the design of the batch coil annealing base are many and substantial. As a result of these changes the conventional batch coil annealing cycle will not only become more cost effective but especially will become a leader in achieving product quality. Product quality will be measured in surface cleanliness, surface appearance, and uniformity of metallurgical properties. Together with the proven flexibility of the BCA process and the ability to achieve superior ductility with average hot metal quality the batch coil annealing will continue to dominate sheet and strip annealing in the ferrous and non ferrous industries.

Inner covers for batch coil annealing are made from heat resistant alloy such as 309 to withstand the temperatures and repeated heating and cooling under production conditions. However, inner covers tend to fail on a regular basis. Failure occurs in one of two general locations. Failures occur in the proximity of the burners where flame gases directly impinge on the outer surface of the inner cover. Failure frequency is often aggravated when burners get out of adjustment and when hot spots are formed on the surface of the cover.

The other major failure location is in the conical frustum section between vertical cylinder section and horizontal bottom flange. Failure in both cases occurs by crack formation. Failure leads to increased leakage of protective atmosphere gas. In case of HNX gas such leakage is tolerable as long as the crack is still small. In case of high hydrogen content atmospheres such cracks result in a larger loss of atmosphere due to the lower density of such mixtures and will eventually create an unsafe condition when pure hydrogen escapes through a large crack and mixes with air.

Numerous efforts have been made to eliminate or reduce the frequency of such failures. More expensive alloys have been used, radiation shields have been added to the inner cover in the vicinity of the burners, corrugated inner covers have been tried, and numerous attempts have been made to devise other angles, different welding techniques, and modified flange cooling or heating approaches.

Despite these persisting efforts by equipment suppliers and alloy fabricators inner covers continue to fail on a regular basis. The inventive design extends the life of inner covers and accordingly reduces operating costs by reduction of maintenance and replacement requirements. Two independent measures are used. First, uniform heat fluxes generated by the jet impingement heating cover will prevent overheating of the vertical section of the inner cover and will significantly extend the life of vertical portion of the cover.

The failures in the conical frustum section have been addressed by revising the design of this section. A major problem with the existing design is the creation of stresses by thermally induced differential expansion. These stresses can become quite high and result eventually in a thermal fatigue failure. In the inventive design the conical frustum section is maintained at a reasonably uniform temperature and the temperature differential is then occurring in a cylindrical section where such differentials can be better tolerated.

The conical frustum section is welded to the outside of the inner cover while the inner cover continues to extend downward. This design has two advantages. It prevents unnecessary turbulence at the transition from base to inner cover and accordingly conserves unproductive expense of horsepower and electric energy. Its other advantage is that the extended section can also serve as support for the inner cover and can protect the seal surfaces on the inner cover flange.

The conical frustum section moves the diameter of the inner cover further outside before continuing with a cylindrical section. Insulation is placed into the annulus that is formed by two concentric cylindrical sections. The outer cylindrical section is further insulated to prevent excessive heating or cooling from the outside. The outer cylindrical section, protected on either side by insulation, is leading downward and is welded to the flange directly without any intermediate conical section.

The flange is cooled by radiation from the lower water cooled sealing surface to maintain the inner cover flange at a temperature which typically should not exceed the maximum use temperature of the employed elastomeric seal which is typically between 350° F. and 450° F. The flange can be used with 0-rings as well as with ceramic seals. In either case, an improvement in life expectancy will be observed.

The thickness of the insulation and the length of the cylindrical section depend on maximum temperature gradients one wants to restrict the design to. Temperature gradients in the hot transition region, the conical frustum section welded to the inner cover, should be kept as small as possible.

The invention has been described with reference to a preferred embodiment and alternative embodiments. Obviously, modifications and alterations will occur to others skilled in the art upon reading and understanding the detailed description. It is intended to include all such modifications and alternations insofar as they come within the scope of the present invention.

Having thus described the invention, it is now claimed:

1. In a bell shaped, batch furnace for annealing a plurality of coils of wound metal strip, said coils being vertically stacked on a base and covered by an inner cover removably sealed to said base; said inner cover, in turn, being covered by an outer cover removably sealed to said base; said outer cover having burners for heating said inner cover in turn heating said coils contained therein; said base including i) support means for supporting said coils at a fixed elevation within said inner cover; ii) a recirculating fan for drawing furnace atmosphere from said inner cover into said base and pumping said furnace atmosphere back into said inner cover; iii) a generally cylindrical containment wall spaced radially outwardly from said recirculating fan for preventing escape of furnace atmosphere from said base, and a iv) diffuser for directing said furnace atmosphere from said inner cover into said base, the improvement comprising:

auxiliary heating means including burners for heating said containment wall, and said diffuser effective to direct said withdrawn furnace atmosphere into heat transfer contact with said containment wall whereby said furnace atmosphere is further heated prior to being admitted to said inner cover for additionally heating the bottom most edge portion of the bottom coil thereby uniformly heating the top coil and the bottom coil.

2. The improvement of claim 1 further including cooling means for cooling said containment wall and control means for sequencing said heating and said cooling means so that said cooling means is activated after said heating means is deactivated.

3. The improvement of claim 1 wherein said support means includes a plurality of vertically-extending spacer strips extending radially outwardly from a first imaginary circle having a diameter not smaller than the inside diameter of said coils to a second imaginary circle having a diameter at least as great as the outside diameter of said coils.

4. The improvement of claim 1 wherein said support means includes a plurality of vertically extending spacer strips for supporting said coils and said heating means includes a gas fired burner for heating said containment wall.

5. In a bell shaped, batch furnace for annealing a plurality of coils of wound metal strip, said coils being vertically stacked on a base and covered by an inner cover removably sealed to said base; said inner cover, in turn, being covered by an outer cover removably sealed to said base; said base including i) support means for supporting said coils at a fixed elevation within said inner cover; ii) a recirculating fan for drawing furnace atmosphere from said inner cover into said base and pumping said furnace atmosphere back into said inner cover; iii) a generally cylindrical containment wall spaced radially outwardly from said recirculating fan for preventing escape of furnace atmosphere from said base, and a iv) diffuser for directing said furnace atmosphere from said inner cover into said base, the improvement comprising:

heating means for heating said containment wall, and said diffuser effective to direct said withdrawn furnace atmosphere into heat transfer contact with said containment wall whereby said furnace atmosphere is heated prior to being admitted to said inner cover for providing more uniform heating between the top most edge portion of the top coil with the bottom most edge portion of the bottom coil;

said support means including a plurality of vertically extending spacer strips for supporting said coils and said heating means includes a gas fired burner for heating said containment wall; and said diffuser means includes a plurality of radially-extending jet impingement tubes, said fan having an impeller centrally disposed within a fan bung, said fan bung occupying a central circular area of said base, each impingement tube extending from a position spaced relatively close to said fan bung to a position adjacent to said containment wall whereby said furnace atmosphere is drawn by said furnace fan into said base and caused to change direction and flow radially outwardly through said impingement tubes into jet impingement contact with said containment wall.

6. The improvement of claim 5 wherein each impingement tube has a radially inwardly positioned inlet and a radially outwardly positioned outlet, said inlet being of a smaller diameter than said outlet.

7. The improvement of claim 5 wherein each impingement tube has a radially inwardly positioned inlet and a radially outwardly positioned outlet, said inlet being approximately the same diameter as said outlet.

8. The improvement of claim 5 further including a second cylindrical burner wall spaced radially outwardly from said containment wall and vertically extending a length approximately equal to that of said containment wall, said containment wall and said burner wall defining an annular, vertically extending heat transfer space for heating said containment wall.

9. The improvement of claim 8 further including a flue exhaust passage in fluid communication with one axial end of said heat transfer space and said burner in fluid communication with the opposite axial end of said heat transfer space.

10. The improvement of claim 9 further including a plurality of vertically spaced baffles within said heat transfer space each baffle extending radially outwardly from said containment wall to said burner wall, and having at least one slitted opening; said slitted openings in any adjacent baffle pair circumferentially offset with respect to one another whereby said containment wall becomes convectively heated by jet impingement turbulence created between vertically adjacent baffles.

11. The improvement of claim 10 further including cooling means for cooling said containment wall, and control means for sequencing said heating and said cooling means so that said cooling means is activated after said heating means has been deactivated.

12. The improvement of claim 11 further including a water jacket in heat transfer contact with said burner wall, said sequencing control means furnishing a coolant to said water jacket when said burner means is not activated.

13. The improvement of claim 5 wherein said inner cover has a vertically extending cylindrical section, a closed end section at one axial end of said cylindrical section and an open end at the opposite axial end of said cylindrical section; said open end including an annular flange end and a frusto-conical section extending between said annular flange and said cylindrical section, and a cylindrical baffle of about the same diameter as said cylindrical section extending vertically downwardly from the juncture of said frusto-conical section to a position generally adjacent said annular flange, and said containment wall being about the same diameter as said cylindrical baffle whereby furnace atmosphere recirculated by said recirculating fan does not impinge said annular flange.

14. The improvement of claim 13 wherein said base has an annular sealing face in contact with said annular flange of said inner cover and sealing means for removably sealing said annular flange with said sealing face.

15. The improvement of claim 14 further including means to maintain said annular flange at temperatures less than the annealing temperature that said coils are heated to whereby said cylindrical baffle prevents the hot furnace atmosphere directly contacting said annular flange and said frustoconical section and causing thermal fatigue and/or shock thereto.

16. The improvement of claim 15 wherein said support means includes a plurality of vertically extending spacer strips for supporting said coils and said heating means includes a gas fired burner, for heating said containment wall.

17. The improvement of claim 16 wherein said diffuser means includes a plurality of radially-extending jet impingement tubes, said fan having an impeller centrally disposed within a fan bung, said fan bung occupying a central, circular area of said base, each impingement tube extending from a position spaced relatively close to said fan bung to a position adjacent to said containment wall whereby said furnace atmosphere is drawn by said furnace fan into said base and caused to change direction and flow radially outwardly through said impingement tubes into jet impingement contact with said containment wall.

18. A batch coil annealing furnace for annealing a plurality of coils of wound, metal strip, said furnace comprising:

a base upon which said coils are vertically stacked, edge to edge;

an inner cover surrounding said coils, said inner cover having a longitudinally extending cylindrical section, a closed axial end at one side of said cylindrical section and an open axial end at the opposite side, an annular flange at said open axial end, said annular flange removably sealed to said base;

an outer removable cover surrounding said inner cover, said outer cover removably sealed to said base and carrying means including burners to heat the outside of said inner cover for heating said work by radiation from said inner cover;

said base having a recirculating fan for drawing furnace atmosphere from said inner cover into said base and diffuser means for directing said furnace atmosphere axially through said base and back to said inner cover, said base further including a generally cylindrical, containment wall of diameter approximately equal to said inner cover's cylindrical section, and floor means at the bottom of said base, said containment wall and said floor means effective to prevent said furnace atmosphere of said inner cover from leaking past said base; and auxiliary heating means including burners for heating said containment wall, said diffuser means effective to direct said furnace atmosphere into heat transfer impingement contact with said containment wall and thereafter into initial heat transfer contact with the lowermost edge of said lowermost coil whereby the top most coil and lowermost coils are uniformly heated.

19. The batch coil annealing furnace of claim 18 further including cooling means for cooling said containment wall and control means for sequencing said heating and said cooling means so that said cooling means is activated after said heating means is deactivated.

20. A batch coil annealing furnace for annealing a plurality of coils of wound, metal strip, said furnace comprising:

a base upon which said coils are vertically stacked, edge to edge;

an inner cover surrounding said coils, said inner cover having a longitudinally extending cylindrical section, a closed axial end at one side of said cylindrical section and an open axial end at the opposite side, an annular flange at said open axial end, said annular flange removably sealed to said base;

an outer removable cover surrounding said inner cover, said outer cover removably sealed to said base and carrying means to heat the outside of said inner cover;

said base having a recirculating fan for drawing furnace atmosphere from said inner cover into said base and diffuser means for directing said furnace atmosphere axially through said base and back to said inner cover, said base further including a generally cylindrical, containment wall of diameter approximately equal to said inner cover's cylindrical section, and floor means at the bottom of said base, said containment wall and said floor means effective to prevent said furnace atmosphere of said inner cover from leaking past said base;

heat transfer means for heating said containment wall by heat transfer impingement contact with said furnace atmosphere circulated by said fan; and said diffuser means includes a plurality of radially-extending jet impingement tubes, said fan having an impeller centrally disposed within a fan bung, said fan bung occupying a central, circular area of said base, each impingement tube extending from a position spaced relatively close to said fan bung to a position adjacent to said containment wall whereby said furnace atmosphere is drawn by said furnace fan into said base and caused to change direction and flow radially outwardly through said impingement tubes into jet impingement contact with said containment wall.

21. The batch coil annealing furnace of claim 20 further including a second cylindrical burner wall spaced radially outwardly from said containment wall and vertically extending a length approximately equal to that of said containment wall, said containment wall and said burner wall defining an annular, vertically extending heat transfer space for heating said containment wall.

22. The batch coil annealing furnace of claim 20 wherein said inner cover further includes a frusto-conical section extending between said annular flange and said cylindrical section, and a cylindrical baffle of about the same diameter as said cylindrical section extending vertically downward from the juncture of said frusto-conical section with said cylindrical section to a position generally adjacent said annular flange, and said containment wall being about the same diameter as said cylindrical baffle whereby furnace atmosphere recirculated by said recirculating fan does not impinge said annular flange and said frusto-conical section.

23. A batch coil annealing furnace for annealing a plurality of coils of wound, metal strip, said furnace comprising:

a base upon which said coils are vertically stacked, edge to edge;

an inner cover surrounding said coils, said inner cover having a longitudinally extending cylindrical section, a closed axial end at one side of said cylindrical section, and an open axial end at the opposite side of said cylindrical section, said open end including an annular flange for supporting said inner cover on said base and a frusto-conical section extending from said annular flange to said cylindrical section, a cylindrical baffle of approximately the same diameter as said cylindrical section extending from the juncture of said frusto-conical section with said cylindrical section, said cylindrical baffle extending vertically downwardly from said juncture to a vertical position generally adjacent said annular flange;

an outer removable cover surrounding said inner cover and removably sealed to said base said outer cover having means including burners to heat the outside of said inner cover so that said inner cover radiates heat to said coils for heating same;

said base having i) a recirculating fan for drawing furnace atmosphere from said inner cover, ii) diverting means for directing said furnace atmosphere through said base and back to said inner cover; iii) a generally cylindrical, containment wall of diameter approximately equal to said inner cover's cylindrical section; and iv) floor means at the bottom of said base, said containment wall and said floor means effective to keep the atmosphere of said inner cover sealed between and within said base and said inner cover and auxiliary heating means for heating said containment wall, said diverting means effective to direct said furnace atmosphere against containment wall and into said inner cover between said cylindrical baffle and the lowest most coil whereby the temperature of said sections of said inner cover are maintained at uniform temperatures reducing thermal failure of said inner cover.

24. The batch coil annealing furnace of claim 23 wherein said base has an annular sealing face surface in contact with said annular flange of said inner cover and sealing means for removably sealing said annular flange with said sealing face surface.

25. The batch coil annealing furnace of claim 24 wherein said sealing means includes an elastomer seal compressed between said annular flange and said sealing face surface and water jacket cooling means maintaining the temperature of said annular flange adjacent said elastomer seal less than about 450° F.

26. The batch coil annealing furnace of claim 25 further including insulation means to maintain said annular flange and said frusto-conical sections at temperatures less than the annealing temperature that said coils are heated to whereby said cylindrical baffle prevents said hot furnace atmosphere directly contacting said annular flange and said frusto-conical section to prevent varying temperature differentials causing thermal fatigue.

* * * * *